US012312119B2

(12) United States Patent
Mizusawa et al.

(10) Patent No.: US 12,312,119 B2
(45) Date of Patent: May 27, 2025

(54) FEEDING DEVICE AND IMAGE FORMING APPARATUS

(71) Applicants: Hiroshi Mizusawa, Tokyo (JP); Kazune Nakamura, Tokyo (JP); Yosuke Eguchi, Tokyo (JP)

(72) Inventors: Hiroshi Mizusawa, Tokyo (JP); Kazune Nakamura, Tokyo (JP); Yosuke Eguchi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 472 days.

(21) Appl. No.: 17/719,394

(22) Filed: Apr. 13, 2022

(65) Prior Publication Data

US 2022/0332455 A1 Oct. 20, 2022

(30) Foreign Application Priority Data

Apr. 16, 2021 (JP) ..... 2021-069797

(51) Int. Cl.

| | |
|---|---|
| ***B65H 1/26*** | (2006.01) |
| ***B65B 69/00*** | (2006.01) |
| ***B65H 3/46*** | (2006.01) |

(52) U.S. Cl.

CPC ..... *B65B 69/0025* (2013.01); *B65H 3/46* (2013.01); *B65H 2801/06* (2013.01)

(58) Field of Classification Search

CPC .... B65H 1/266; B65H 1/04; B65H 2701/139; B65H 2701/1849; B65H 2701/1944; B65H 2301/4221; B65B 69/0025; B65B 69/00

See application file for complete search history.

(56) References Cited

U.S. PATENT DOCUMENTS

| | | | | |
|---|---|---|---|---|
| 2012/0061903 | A1 | 3/2012 | Eguchi et al. | |
| 2018/0354734 | A1 * | 12/2018 | Oshima | B65H 3/0669 |
| 2020/0371465 | A1 | 11/2020 | Nakamura et al. | |

FOREIGN PATENT DOCUMENTS

| | | | |
|---|---|---|---|
| JP | S64-009110 U | | 1/1989 |
| JP | 061564561 A | * | 6/1994 |
| JP | 10-006287 | | 1/1998 |
| JP | 2020-125205 | | 8/2020 |

OTHER PUBLICATIONS

Office Action issued Oct. 1, 2024 in Japanese Patent Application No. 2021-069797, 6 pages.

* cited by examiner

*Primary Examiner* — Luis A Gonzalez
(74) *Attorney, Agent, or Firm* — XSENSUS LLP

(57) ABSTRACT

A feeding device to feed a sheet in a feeding direction includes a mount on which a substantially rectangular parallelepiped sheet pack is mountable; a first cutter to cut, in the feeding direction, a first side surface on one end side in a width direction orthogonal to the feeding direction out of four side surfaces of the sheet pack; a second cutter to cut, in the width direction, a second side surface on a downstream side in the feeding direction out of the four side surfaces; and a third cutter to cut, in the feeding direction, a third side surface on another end side in the width direction out of the four side surfaces. Height positions cut by the first cutter, the second cutter, and the third cutter coincide with each other. Cut portions by the first cutter, the second cutter, and the third cutter are coupled to each other.

12 Claims, 7 Drawing Sheets

FEEDING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-069797, filed on Apr. 16, 2021, in the Japan Patent Office, the entire disclosure of which is incorporated by reference herein.

BACKGROUND

Technical Field

Embodiments of the present disclosure relate to a feeding device that feeds a sheet, and an image forming apparatus such as a copying machine, a printer, a facsimile, or a multifunction peripheral thereof, and a printing machine provided with the same.

Related Art

A device has been known that moves a cutter member by a moving device to cut a wrapping material of a sheet pack wrapping a sheet bundle in which a plurality of sheets is stacked.

For example, such device moves in a U-shape one cutter along three side surfaces out of four side surfaces of a wrapped package (sheet pack) wrapping printing paper (sheet bundle) to cut the three side surfaces. Then, a user takes out the printing paper from the wrapped package the three side surfaces of which are cut.

SUMMARY

According to an embodiment of the present disclosure, there is provided a feeding device to feed a sheet in a feeding direction. The feeding device includes a mount, a first cutter, a second cutter, and a third cutter. A substantially rectangular parallelepiped sheet pack including a sheet bundle and a wrapping material wrapping the sheet bundle is mountable on the mount. The first cutter cuts, in the feeding direction, an upper portion and a lower portion of a first side surface located on one end side of the sheet pack in a width direction orthogonal to the feeding direction out of four side surfaces of the sheet pack mounted on the mount. The second cutter cuts, in the width direction, an upper portion and a lower portion of a second side surface located on a downstream side of the sheet pack in the feeding direction out of the four side surfaces of the sheet pack mounted on the mount. The third cutter cuts, in the feeding direction, an upper portion and a lower portion of a third side surface located on another end side of the sheet pack in the width direction out of the four side surfaces of the sheet pack mounted on the mount. A height position cut by the first cutter, a height position cut by the second cutter, and a height position cut by the third cutter coincide with each other. A cut portion of the first side surface cut by the first cutter, a cut portion of the second side surface cut by the second cutter, and a cut portion of the third side surface cut by the third cutter are coupled to each other.

According to another embodiment of the present disclosure, there is provided an image forming apparatus that includes the feeding device described above.

According to still another embodiment of the present disclosure, there is provided a feeding device to feed a sheet in a predetermined feeding direction. The feeding device includes a mount, a first cutter, a second cutter, and a third cutter. A substantially rectangular parallelepiped sheet pack including a sheet bundle and a wrapping material wrapping the sheet bundle is mountable on the mount. The first cutter cuts, in the feeding direction, an upper portion and a lower portion of a first side surface located on one end side of the sheet pack in a width direction orthogonal to the feeding direction out of four side surfaces of the sheet pack mounted on the mount. The second cutter cuts, in the width direction, an upper portion and a lower portion of a second side surface located on a downstream side of the sheet pack in the feeding direction out of the four side surfaces of the sheet pack mounted on the mount. The third cutter cuts, in the feeding direction, an upper portion and a lower portion of a third side surface located on another end side of the sheet pack in the width direction out of the four side surfaces of the sheet pack mounted on the mount. Height positions of travel paths of the first cutter, the second cutter, and the third cutter coincide with each other, and the travel paths are coupled to each other.

According to still yet another embodiment of the present disclosure, there is provided an image forming apparatus that includes the feeding device described above.

BRIEF DESCRIPTIONS OF THE DRAWINGS

The aforementioned and other aspects, features, and advantages of the present disclosure would be better understood by reference to the following detailed description when considered in connection with the accompanying drawings, wherein.

Figure 1:
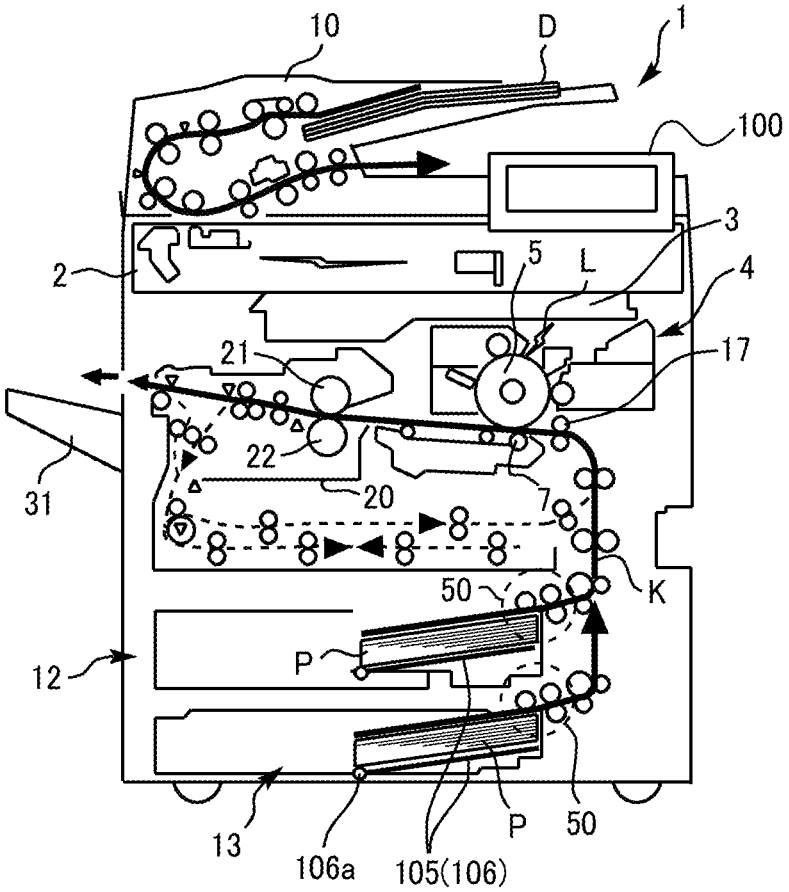
FIG. 1 is a general configuration diagram illustrating an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, modes for carrying out this disclosure will be described in detail with reference to the drawings. Note that, in the drawings, identical reference numerals are assigned to identical or equivalent components and a description of those components may be appropriately simplified or omitted.

First, with reference to FIG. 1, a description is given of an overall configuration and an operation of an image forming apparatus 1.

In FIG. 1, an image forming apparatus 1 illustrated as a copying machine includes a document reader 2 that optically reads image data of a document D, an exposure device 3 that irradiates a photoconductor drum 5 with exposure light L based on the image data read by the document reader 2, an image forming device 4 that forms a toner image (image) on the photoconductor drum 5, and a transfer device (image forming device) 7 that transfers the toner image formed on the photoconductor drum 5 to a sheet P.

The image forming apparatus 1 further includes a document feeder (automatic document feeder) 10 that conveys the set document D to the document reader 2 and feeding devices 12 and 13 that feed the sheet P accommodated in a sheet tray.

The image forming apparatus 1 also includes a registration roller pair (conveyance roller pair) 17 that conveys the sheet P toward the transfer device 7 and a fixing device 20 that fixes the toner image (unfixed image) carried on the sheet P. The fixing device 20 includes a fixing roller 21 and a pressure roller 22. The sheet P ejected from a body of the image forming apparatus 1 is stacked on an output tray 31.

A mount 105 includes a lifting plate 106 capable of lifting up and down in each of the feeding devices 12 and 13, and a feeding mechanism 50 as a feeder is installed in each of the feeding devices 12 and 13.

With reference to FIG. 1, a description is given of a basic image forming operation of the image forming apparatus 1.

First, the document D is conveyed (fed) from a document table in a direction indicated by arrow in the drawing by a conveyance roller of the document feeder 10 and passes over the document reader 2. At that time, the document reader 2 optically reads the image data of the document D that passes above the same.

The optical image data read by the document reader 2 is converted into electrical signals and then transmitted to the exposure device 3 (writer). The exposure device 3 emits the exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes (e.g., a charging process, an exposing process, and a developing process) is completed, an image (toner image) corresponding to the image data is formed on the surface of the photoconductor drum 5.

Thereafter, the image formed on the surface of the photoconductor drum 5 is transferred onto the sheet P conveyed by registration roller pair 17 in the transfer device 7 as the image forming device.

By contrast, the sheet P that is conveyed to the transfer device 7 (image forming device) is handled as described below.

First, one feeding device out of a plurality of feeding devices 12 and 13 of the image forming apparatus 1 is automatically or manually selected (for example, it is assumed that the lower feeding device 13 is selected). Then, one uppermost sheet of the sheets P such as paper accommodated in the feeding device 13 is fed by the feeding mechanism 50 and conveyed toward a conveyance path K. Thereafter, the sheet P passes through the conveyance path K on which a plurality of conveyance rollers is arranged, and reaches a position of the registration roller pair 17. At that time, the registration roller pair 17 is in a stopped state. A leading end of the sheet P abuts a nip thereof, so that skew of the sheet P is corrected.

Then, the rotation of the registration roller pair 17 is started, and the sheet P the skew of which is corrected is conveyed toward the transfer device 7 (image forming device) by the registration roller pair 17 at the same timing with the image formed on the photoconductor drum 5 for alignment.

The sheet P after the transfer process passes through a position of the transfer device 7 and then reaches the fixing device 20 via the conveyance path. In the fixing device 20, the sheet P is conveyed between the fixing roller 21 and the pressure roller 22, so that the toner image is fixed to the sheet P by application of heat applied by the fixing roller 21 and pressure applied by the fixing roller 21 and the pressure roller 22, which is a fixing process. The sheet P after the fixing process on which the toner image is fixed is delivered from between the fixing roller 21 and the pressure roller 22 (which is a fixing nip), then discharged from the body of the image forming apparatus 1, and loaded on the output tray 31 as an output image.

Accordingly, a series of image forming processes is completed.

Next, the feeding device according to the present embodiment is described in detail with reference to FIG. 2 and the like.

Although the lower feeding device 13 out of the plurality of feeding devices 12 and 13 included in the body of the image forming apparatus 1 is described below, the upper feeding device 12 also has a configuration substantially similar to that of the lower feeding device 13 except that an installation position is different, so that the description thereof is omitted.

Figure 2:
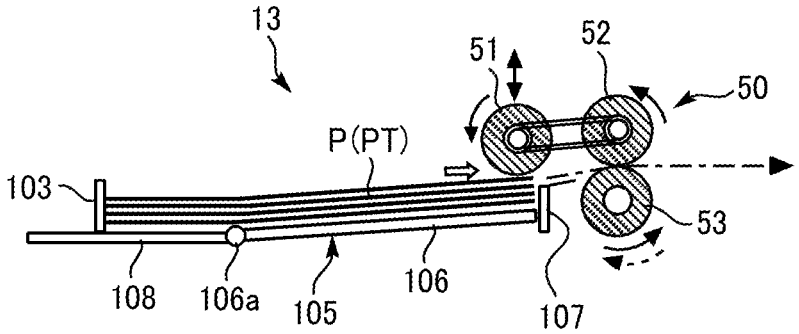
FIG. 2 is a schematic configuration diagram illustrating a feeding device.

With reference to FIG. 2 and the like, in the feeding device 13, the mount 105 formed so that a plurality of sheets P is loadable, the feeding mechanism 50 for feeding the sheets P mounted on the mount 105 and the like.

A part of the mount 105 is liftable up and down so that a downstream side in a feeding direction of the uppermost sheet P mounted (a right side in FIG. 2) reaches a predetermined height position (a position of the pickup roller 51). Specifically, the mount 105 includes the lifting plate 106 rotatable about a rotational center axis **106*a* and a fixing plate 108 that does not lift up and down. The lifting plate 106 is arranged on a downstream side of the fixing plate 108 in the feeding direction, and rotates in normal and opposite directions about the rotational center axis 106*a*** to lift up and down.

With reference to FIG. 2, the feeding mechanism 50 includes a feed roller 52, the pickup roller 51, a separation roller 53 and the like.

The feed roller 52 is arranged on a leading end side (downstream side) in the feeding direction (a direction indicated by white arrow in FIG. 2) with respect to the sheet P mounted on the mount 105, and comes into contact with an upper surface of the uppermost sheet P to rotate (rotate in a counterclockwise direction in FIG. 2) in the feeding direction of the sheet P, thereby feeding the sheet P in the feeding direction indicated by dashed-dotted arrow.

The pickup roller 51 rotates in the counterclockwise direction in FIG. 2 in a travel direction in a state of abutting the surface (upper surface) of the uppermost sheet P mounted on the mount 105, and conveys the sheet P toward a position of the feed roller 52. The pickup roller 51 is contactable with and separable from the sheet P (uppermost sheet P) mounted on the mount 105 (lifting plate 106). That is, the pickup roller 51 is movable between a retracted position where this does not abut the sheet P mounted on the mount 105 and an abutting position where this abuts the sheet P (a position illustrated in FIG. 2).

The separation roller 53 is installed so as to form a nip portion between the same and the feed roller 52.

The separation roller 53 rotates in a forward direction (a direction indicated by broken arrow in FIG. 2, a clockwise direction) in the feeding direction when one sheet P is nipped by the nip portion and when the sheet P is not nipped by the nip portion. On the other hand, when a plurality of sheets is nipped by the nip portion, the separation roller 53 rotates in a direction opposite to the above-described forward direction (a direction indicated by solid arrow in FIG. 2, the counterclockwise direction). As a result, the uppermost sheet P out of the plurality of sheets P nipped by the nip portion is fed in the feeding direction along with the rotation of the feed roller 52, and the lower sheet P is conveyed in the direction opposite to the feeding direction (forward direction), so that multiple feeding of the sheets P is suppressed.

Here, in the feeding device 13 according to the present embodiment, the lifting plate 106 lifts up and down in a vertical direction depending on the number of sheets P loaded on the mount 105 (lifting plate 106) so that the pickup roller 51 may abut the uppermost sheet P loaded on the mount 105 (lifting plate 106). After the pickup roller 51 lowers to a position to abut the upper surface of the sheet P mounted on the mount 105 (lifting plate 106) a position of which in the vertical direction is adjusted, a feeding operation of the sheet P is performed.

The feeding device 13 according to the present embodiment is provided with a pair of side fences 101 and 102 (refer to FIG. 3) that regulates a position in a width direction (a direction perpendicular to a paper surface in FIG. 2) of the sheet P mounted on the mount 105. The side fences 101 and 102 are installed at both ends in the width direction so as to sandwich the sheet P, and are movable in conjunction with each other in the width direction depending on a size of the sheet P in the width direction by a manual movement mechanism (capable of increasing or decreasing an interval in the width direction).

The feeding device 13 according to the present embodiment is provided with a reference fence 107 and an end fence 103 that regulate a position in the feeding direction (a right-left direction in FIG. 2) of the sheet P mounted on the mount 105. The reference fence 107 is installed so that a side surface (leading end) on the downstream side in the feeding direction of the sheet P abuts the same. The end fence 103 is installed so as to abut a side surface (rear end) on the upstream side in the feeding direction of the sheet P, and is movable in the feeding direction in accordance with the size of the sheet P in the feeding direction by the manual movement mechanism.

In the feeding device 13 formed in this manner, in a state in which the sheet P is not set on the mount 105, this state is detected by an end-state sensor (not illustrated), and the pickup roller 51 is in a state retracted to a retracted position.

When the sheet P is set on the mount 105, this state is detected by the end-state sensor, and the pickup roller 51 is moved from the retracted position toward the abutment position (a position illustrated in FIG. 2).

Then, as illustrated in FIG. 2, in a state in which the pickup roller 51 abuts the upper surface of the uppermost sheet P mounted on the mount 105, rotary drive of the pickup roller 51 in the counterclockwise direction is started, and the rotation of the feed roller 52 and the separation roller 53 is started at the same timing. As a result, the uppermost sheet P of a sheet bundle PT mounted on the mount 105 is conveyed by the pickup roller 51 toward the nip portion between the feed roller 52 and the separation roller 53, and further, one sheet P is separated to be conveyed toward the image forming device from the nip portion.

When all the sheets P mounted on the mount 105 are fed and it becomes a state in which no sheet P is set on the mount 105, this state is detected by the end-state sensor, and the pickup roller 51 moves to the retracted position again.

Hereinafter, characteristic configuration and operation of the feeding device 13 (image forming apparatus 1) according to the present embodiment will be described with reference to FIGS. 3 to 10C and the like.

In the feeding device 13 according to the present embodiment, the predetermined number of sheets P of a predetermined size (for example, 500 sheets of A4 size) may be directly set as a sheet pack 300 wrapped in a loaded state (a state of the sheet bundle PT) (refer to FIGS. 4 to 9). Then, a wrapping material 301 (refer to FIG. 4 and the like) of the sheet pack 300 is cut in the feeding device 13, and the sheet P may be fed from the feeding device 13.

Normally, when the sheet P runs out in the feeding device 13, the wrapping material 301 (for example, made of paper) wrapping the sheet bundle PT of the sheet pack 300 is removed, and the sheet bundle PT from which the wrapping material 301 is removed is set in the feeding device 13 (sheet tray) pulled out from the body of the image forming apparatus 1. At that time, there is a risk that the sheet P of the sheet bundle PT is displaced in the width direction and the sheet bundle PT in a positionally displaced state is set in the feeding device 13.

The feeding device 13 is provided with a pair of side fences 101 and 102 that regulates a position in the width direction (a direction perpendicular to a paper surface in FIGS. 1 and 2) of the set sheet bundle PT, and the reference fence 107 and the end fence 103 that regulate a position in a feeding direction (a right-left direction in FIGS. 1 and 2) of the sheet bundle PT. However, the sheets P located on a lower side of the sheet bundle PT having a stronger friction force between the sheets than those located on an upper side do not move when the end fence 103 and the side fences 101 and 102 are moved to abut the sheet bundle PT as described above, so that the above-described positional displacement is less likely to be resolved.

By contrast, in the feeding device 13 according to the present embodiment, the sheet pack 300 from which the wrapping material 301 is not removed may be directly set, and the wrapping material 301 of the set sheet pack 300 is automatically cut, so that the above-described problems are less likely to occur.

Figure 3:
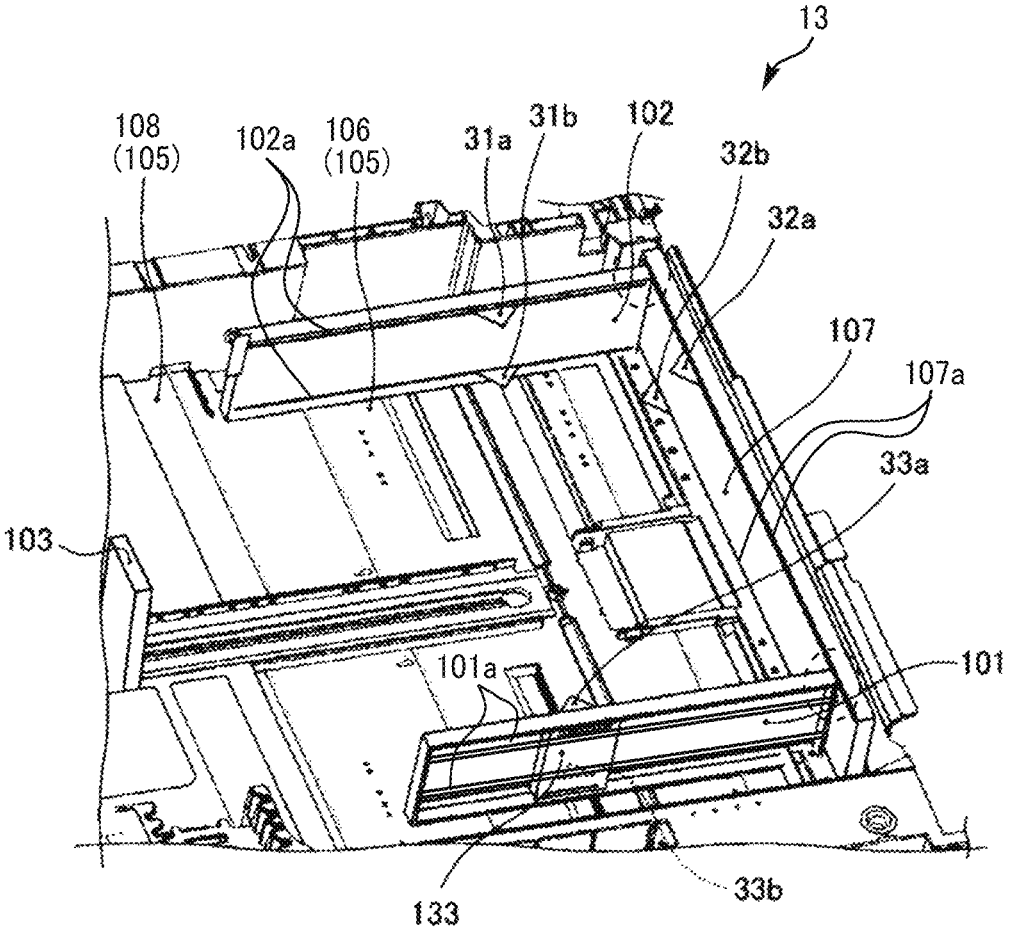
FIG. 3 is a perspective view illustrating a part of the feeding device.
Figure 4:
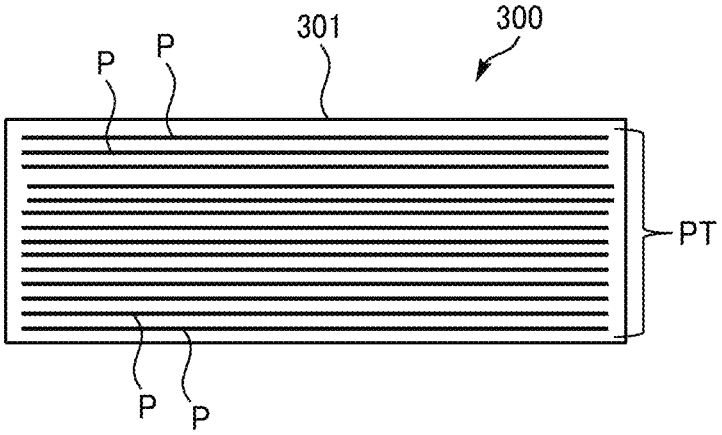
FIG. 4 is a side view illustrating a sheet pack.

As illustrated in FIG. 3, the feeding device 13 (sheet tray) is provided with the mount 105 including the fixing plate 108 and the lifting plate 106. The sheet pack 300 (including the sheet bundle PT and the wrapping material 301 wrapping the sheet bundle PT as illustrated in FIG. 4) having a substantially rectangular parallelepiped shape may be mounted on the mount 105.

The feeding device 13 is provided with a pair of side fences 101 and 102 that determines a position in the width direction of the sheet pack 300 mounted on the mount 105, the reference fence 107 that determines a position on the downstream side in the feeding direction of the sheet pack 300 mounted on the mount 105, and the end fence 103 that determines a position on the upstream side in the feeding direction of the sheet pack 300 mounted on the mount 105.

Each of the pair of side fences 101 and 102 and the end fence 103 is moved in accordance with the size of the sheet pack 300 (sheet bundle PT) as described above with reference to FIG. 2 and the like.

Here, the feeding device 13 according to the present embodiment is provided with first to third cutting members 31*a* and 31*b*, 32*a* and 32*b*, and 33*a* and 33*b* for cutting the wrapping material 301 of the sheet pack 300 set therein.

Figure 5:
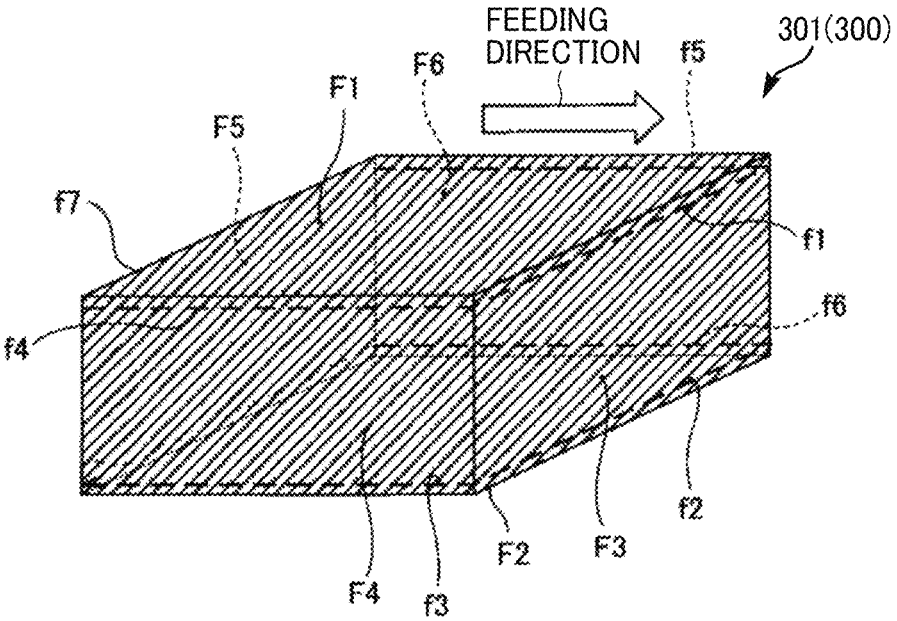
FIG. 5 is a perspective view illustrating a cut portion in the sheet pack.
Figure 6:
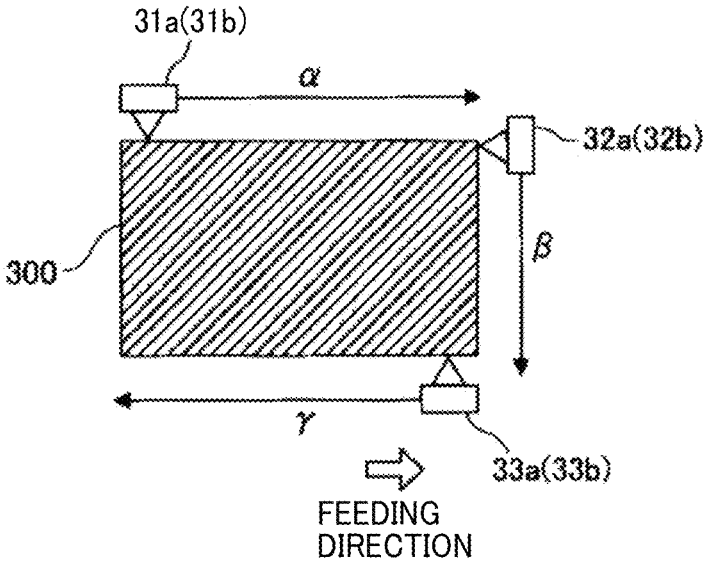
FIG. 6 is a top view illustrating an operation of first to third cutting members.
Figure 7:
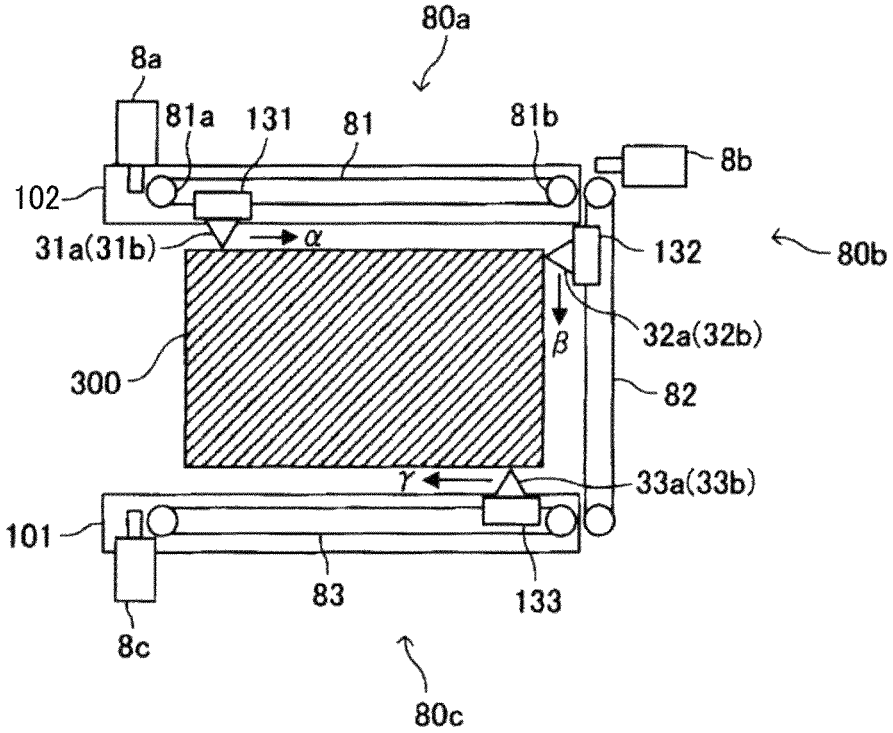
FIG. 7 is a schematic diagram illustrating first to third moving devices.

With reference to FIGS. 3, 6, 7 and the like, the first cutting members 31*a* and 31*b* serving as a first cutter are moved by a first moving device 80*a* to cut an upper portion and a lower portion of a first side surface F6 located on one end side in the width direction (a direction orthogonal to the feeding direction) out of four side surfaces F3 to F6 (refer to FIG. 5) of the sheet pack 300 mounted on the mount 105 in the feeding direction (a direction indicated by arrow in FIG. 5, a direction indicated by arrow α in FIGS. 6 and 7).

Specifically, the first cutting members 31*a* and 31*b* move along a rectangular hole-shaped first guide 102*a* formed to extend in the feeding direction in an upper portion and a lower portion of a first side fence 102 located on one end side in the width direction out of the pair of side fences 101 and 102.

The second cutting members 32*a* and 32*b* serving as a second cutter are moved by a second moving device 80*b* to cut an upper portion and a lower portion of the second side surface F3 located on the downstream side in the feeding direction out of the four side surfaces F3 to F6 (refer to FIG. 5) of the sheet pack 300 mounted on the mount 105 in the width direction (a direction indicated by arrow β in FIGS. 6 and 7).

Specifically, the second cutting members 32*a* and 32*b* move along a rectangular hole-shaped second guide 107*a* formed to extend in the width direction in an upper portion and a lower portion of the reference fence 107.

The third cutting members 33*a* and 33*b* serving as a third cutter are moved by a third moving device 80*c* to cut an upper portion and a lower portion of the third side surface F4 located on the other end side in the width direction out of the four side surfaces F3 to F6 (refer to FIG. 5) of the sheet pack 300 mounted on the mount 105 in the feeding direction (a direction opposite to the direction indicated by arrow in FIG. 5, a direction indicated by arrow γ in FIGS. 6 and 7).

Specifically, the third cutting members 33*a* and 33*b* move along a rectangular hole-shaped third guide 101*a* formed to extend in the feeding direction in an upper portion and a lower portion of a second side fence 101 located on the other end side in the width direction out of the pair of side fences 101 and 102.

This will be described in more detail below.

The first side fence 102 is provided with a first upper cutting member 31*a* and a first lower cutting member 31*b* as the first cutting members so as to project inward (toward the center in the width direction) from a sheet regulating surface of the first side fence 102. The first upper cutting member 31*a* and the first lower cutting member 31*b* are provided on the first side fence 102 so as to be horizontally movable in the feeding direction along the first guide 102*a*.

Similarly, the second side fence 101 is provided with a third upper cutting member 33*a* and a third lower cutting member 33*b* as the third cutting members so as to project inward (toward the center in the width direction) from a sheet regulating surface of the second side fence 101. The third upper cutting member 33*a* and the third lower cutting member 33*b* are provided on the second side fence 101 so as to be horizontally movable in the feeding direction along the third guide 101*a*.

The reference fence 107 is provided with a second upper cutting member 32*a* and a second lower cutting member 32*b* as the second cutting members so as to project inward (toward the upstream side in the feeding direction) from a sheet regulating surface of the reference fence 107. The second upper cutting member 32*a* and the second lower cutting member 32*b* are provided on the reference fence 107 so as to be horizontally movable in the width direction along the second guide 107*a*.

The first to third cutting members 31*a* and 31*b*, 32*a* and 32*b*, and 33*a* and 33*b* may cut the wrapping material 301 as indicated by broken lines f1 to f6 in FIG. 5, and a portion that comes into contact with the wrapping material 301 is formed in a cutter shape. The cutter shape of each of the first to third cutting members 31*a* and 31*b*, 32*a* and 32*b*, and 33*a* and 33*b* may be a double-edged shape or a single-edged shape. In particular, in the present embodiment, as described later, each of the first to third cutting members 31*a* and 31*b*, 32*a* and 32*b*, and 33*a* and 33*b* does not reciprocate to cut the wrapping material 301, but moves in one direction to cut the wrapping material 301, so that this may have the single-edged shape in accordance with the moving direction.

More specifically, as illustrated in FIG. 5, in the wrapping material 301, an upper side f4 (upper portion) of the third side surface F4, which is a surface facing the second side fence 101 and parallel to the feeding direction, is cut by the third upper cutting member 33*a*, and a lower side f3 (lower portion) of the third side surface F4 is cut by the third lower cutting member 33*b*.

In the wrapping material 301, an upper side f5 (upper portion) of the first side surface F6, which is a surface facing the first side fence 102 and parallel to the feeding direction, is cut by the first upper cutting member 31*a*, and a lower side f6 (lower portion) of the first side surface F6 is cut by the first lower cutting member 31*b*.

In the wrapping material 301, an upper side f1 (upper portion) of the second side surface F3, which is a surface facing the reference fence 107 and parallel to the width direction, is cut by the second upper cutting member 32*a*, and a lower side f2 (lower portion) of the second side surface F3 is cut by the second lower cutting member 32*b*.

FIG. 6 is a view illustrating an operation of the first to third cutting members 31*a* and 31*b*, 32*a* and 32*b*, and 33*a* and 33*b* when cutting the wrapping material 301.

As illustrated in FIG. 6, when the first cutting members 31*a* and 31*b* (first upper cutting member and first lower cutting member) simultaneously move horizontally in the direction indicated by arrow α, the upper side f5 and the lower side f6 of the first side surface f6 of the wrapping material 301 are cut.

When the second cutting members 32*a* and 32*b* (second upper cutting member and second lower cutting member) simultaneously move horizontally in the direction indicated by arrow β, the upper side f1 and the lower side f2 of the second side surface F3 of the wrapping material 301 are cut.

When the third cutting members 33*a* and 33*b* (third upper cutting member and third lower cutting member) simultaneously move horizontally in the direction indicated by arrow γ, the upper side f4 and the lower side f3 of the third side surface f4 of the wrapping material 301 are cut.

FIG. 7 is a diagram illustrating the first to third moving devices 80*a* to 80*c* that move the first to third cutting members 31*a* and 31*b*, 32*a* and 32*b*, and 33*a* and 33*b*.

Since the first moving device 80*a* that moves the first cutting members 31*a* and 31*b*, the second moving device 80*b* that moves the second cutting members 32*a* and 32*b*, and the third moving device 80*c* that moves the third cutting members 33*a* and 33*b* are formed similarly, hereinafter, the configuration of the first moving device 80*a* will be described in detail, and the description of the second and third moving devices 80*b* and 80*c* will be appropriately omitted.

The first moving device 80*a* is provided with a support stand 131 that supports the first upper cutting member 31*a* and the first lower cutting member 31*b* and is slidably held by the first side fence 102. The support stand 131 is fixedly attached to a belt 81 stretched and supported by a driving roller 81*a* and a driven roller 81*b*. A driving force is transmitted from a motor 8*a* to the driving roller 81*a* via a two-stage gear including a worm gear and a pulley gear. When the driving roller 81*a* receives the driving force from the motor 8*a* and rotates in a counterclockwise direction in FIG. 7, the belt 81 rotates in the counterclockwise direction. As a result, the first cutting members 31*a* and 31*b* move horizontally in the direction indicated by arrow α together with the support stand 131, and the upper side f5 and the lower side f6 of the first side surface f6 of the wrapping material 301 are cut.

Similarly, when a motor 8*b* of the second moving device 80*b* rotates in the counterclockwise direction in FIG. 7, a belt 82 rotates in the counterclockwise direction, and the second cutting members 32*a* and 32*b* horizontally move in the direction indicated by arrow β together with a support stand 132. As a result, the upper side f1 and the lower side f2 of the second side surface F3 of the wrapping material 301 are cut.

Similarly, when a motor 8*c* of the third moving device 80*c* rotates in the counterclockwise direction in FIG. 7, a belt 83 rotates in the counterclockwise direction, and the third cutting members 33*a* and 33*b* horizontally move in the direction indicated by arrow γ together with a support stand 133. As a result, the upper side f4 and the lower side f3 of the third side surface F4 of the wrapping material 301 are cut.

The first to third cutting members 31*a* and 31*b*, 32*a* and 32*b*, and 33*a* and 33*b* are returned to a reference position (a position in the vicinity of the position illustrated in FIG. 6, a position that does not interfere with a subsequent feeding operation of the sheet P) by the first to third moving devices 80*a* to 80*c*, respectively, after the above-described cutting of the wrapping material 301 is finished.

As described above, in the present embodiment, the first cutting members 31*a* and 31*b* move from the upstream side to the downstream side in the feeding direction to cut the sheet pack 300. The second cutting members 32*a* and 32*b* move from the one end side to the other end side in the width direction to cut the sheet pack 300. The third cutting members 33*a* and 33*b* move from the downstream side to the upstream side in the feeding direction to cut the sheet pack 300.

That is, as illustrated in FIG. 6, as seen from above, the sheet pack 300 is cut in the clockwise direction (the same rotational direction) by the first to third cutting members 31*a* and 31*b*, 32*a* and 32*b*, and 33*a* and 33*b*.

By moving the first to third cutting members 31*a* and 31*b*, 32*a* and 32*b*, and 33*a* and 33*b* in the same rotational direction in this manner, a problem that the first to third cutting members 31*a* and 31*b*, 32*a* and 32*b*, and 33*a* and 33*b* collide with each other is less likely to occur. In particular, by controlling the first to third cutting members 31*a* and 31*b*, 32*a* and 32*b*, and 33*a* and 33*b* to simultaneously start moving from the reference position, such problem is reliably less likely to occur. Even when the movement is not simultaneously started in this manner, by starting the movement of the cutting member in the vicinity before the adjacent cutting member reaches a position where the cutting is completed, such problem is less likely to occur.

In the present embodiment, also when the first cutting members 31*a* and 31*b* are moved from the downstream side to the upstream side in the feeding direction to cut the sheet pack 300, the second cutting members 32*a* and 32*b* are moved from the other end side to one end side in the width direction to cut the sheet pack 300, and the third cutting members 33*a* and 33*b* are moved from the upstream side to the downstream side in the feeding direction to cut the sheet pack 300 (even when the cutting is performed in the opposite direction (clockwise direction) in FIG. 6), the similar effect may be obtained.

Figure 8A:
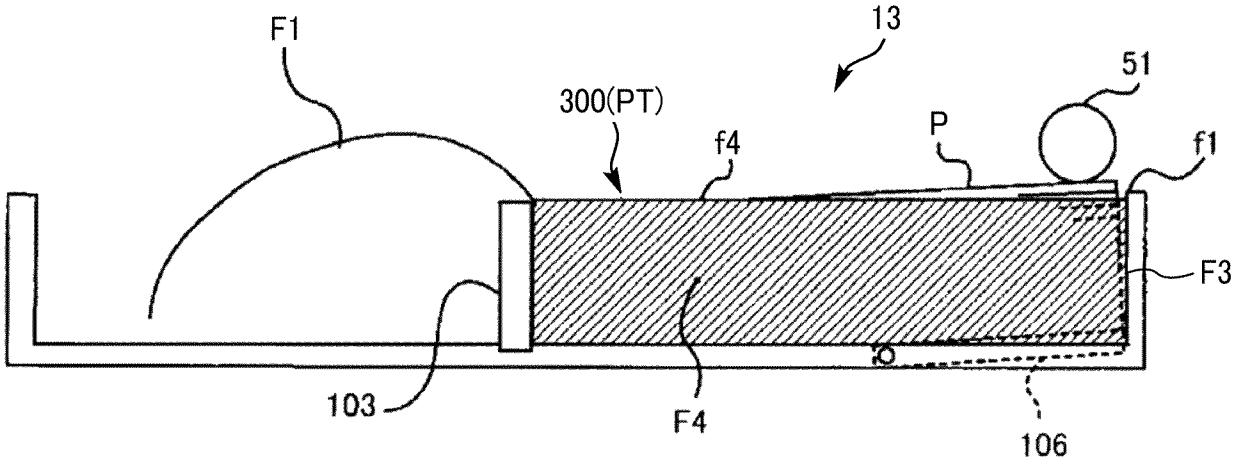
FIGS. 8A and 8B are schematic diagrams illustrating the feeding device after cutting a wrapping material of the sheet pack and turning an upper surface.
Figure 8B:
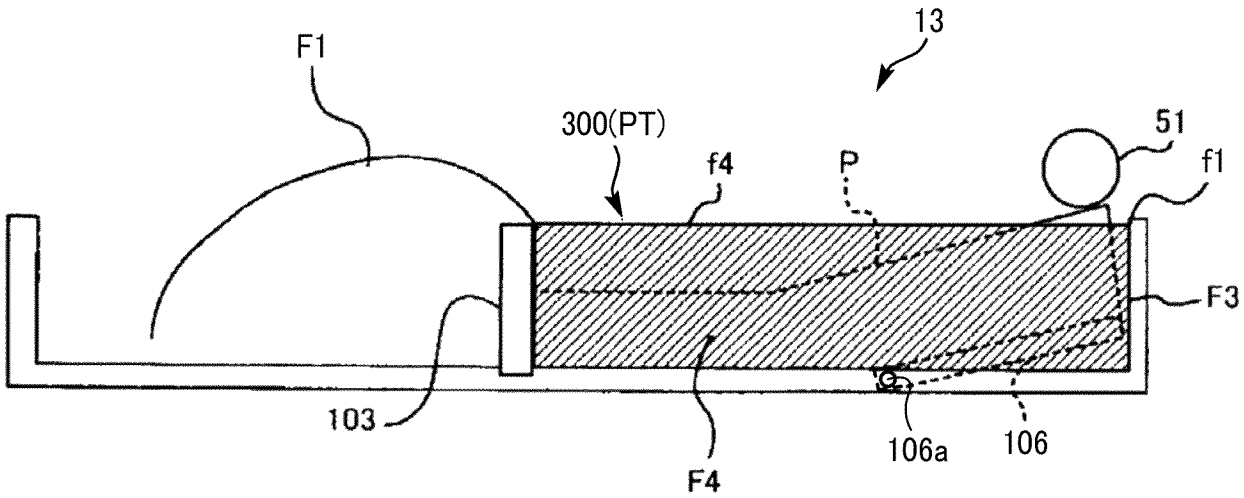

FIGS. 8A and 8B are diagrams illustrating the feeding device 13 that accommodates the sheet pack 300 (sheet bundle PT) in a state in which the wrapping material 301 is cut.

When setting the sheet pack 300 in the feeding device 13, a user operates an operation display panel 100 (refer to FIG. 1) to execute a cutting mode (a control mode for cutting the sheet pack 300). A detection device that detects that the sheet pack 300 is set may be provided in the feeding device 13, and the cutting mode may be automatically executed by using the detection by the detection device as a trigger.

When the cutting mode is executed, the cutting operation described above with reference to FIGS. 6 and 7 is performed, and the upper and lower sides (upper and lower portions) of the first to third side surfaces F6, F4, and F3 of the wrapping material 301 are cut as described above. When such cutting operation is finished, a controller notifies the operation display panel 100 that the cutting operation is finished, and issues an instruction to pull out the feeding device 13 from the body of the image forming apparatus 1 and turn the upper surface F1 of the wrapping material 301. The user pulls out the feeding device 13 and turns the upper surface F1 of the wrapping material 301 to the upstream side in the feeding direction on the basis of the instruction displayed on the operation display panel 100. In the present embodiment, since the upper sides f1, f5, and f4 of the second side surface F3, the first side surface F6, and the third side surface F4, respectively, of the wrapping material 301 are cut, the upper surface F1 of the wrapping material 301 may be turned with the upper side f7 of the fourth side surface F5 (refer to FIG. 5) on the upstream side in the feeding direction as a fulcrum. As the upper surface F1 of the wrapping material 301 is turned in this manner, the upper surface of the sheet bundle PT wrapped with the wrapping material 301 is exposed as illustrated in FIG. 8A.

When the upper surface F1 of the wrapping material 301 is turned to expose the upper surface of the sheet bundle PT as illustrated in FIG. 8A, the feeding device 13 is pushed into the body of the image forming apparatus 1, and a turning operation completion button displayed on the operation display panel 100 is pressed. As a result, the cutting operation is completed.

When the sheet P is fed from the feeding device 13, the lifting plate 106 rotates in the counterclockwise direction in FIGS. 8A and 8B about the rotational center axis 106*a*, and the uppermost sheet P abuts the pickup roller 51. At that time, since the lower sides f2, f6, and f3 of the second side surface F3, the first side surface F6, and the third side surface F4, respectively, of the wrapping material 301 are cut, the downstream side in the feeding direction of the second side surface F3, the first side surface F6, and the third side surface F4 does not lift up following the lower surface F2 (refer to FIG. 5) of the wrapping material 301 loaded on the lifting plate 106 and stay there. As a result, as illustrated in FIG. 8B, the upper portion on the downstream side in the feeding direction of the sheet bundle PT lifted up by the lifting plate 106 is located above the upper sides f1, f5, and f4 of the second side surface F3, the first side surface F6, and the third side surface F4, respectively, of the wrapping material 301. Therefore, when the uppermost sheet P of the sheet bundle PT is fed by the pickup roller 51, the sheet P is excellently fed without being caught on the second side surface F3 and the like of the wrapping material 301.

Since the second side surface F3, the first side surface F6, and the third side surface F4 continue staying there without being lifted up together with the lifting plate 106, as illustrated in FIG. 8B, even when the number of sheets of the sheet bundle PT decreases and the height of the sheet bundle PT decreases due to the repeated feeding operation, the sheets P to be fed are excellently fed without being caught on the second side surface F3 and the like.

Since the second side surface F3, the first side surface F6, and the third side surface F4 continue staying there without being lifted up together with the lifting plate 106, a problem does not occur that the second side surface F3, the first side surface F6, and the third side surface F4 collide with a member located above the feeding device 13 and these side surfaces are crushed, and excellent feeding may be performed.

As described above, in the present embodiment, it is possible to cut the wrapping material 301 of the sheet pack 300 in the feeding device 13 and feed the sheet P without any problem while leaving the wrapping material 301. Therefore, as compared with a case where the sheet bundle PT is taken out from the cut sheet pack 300 and the taken out sheet bundle PT is set in the feeding device 13, it takes less time and effort, and the positional displacement of the sheet bundle PT in the feeding device 13 described above does not occur.

In the present embodiment, since the three side surfaces F3, F4, and F6 of the wrapping material 301 are cut for each side surface by the three cutting members 31*a* and 31*b*, 32*a* and 32*b*, and 33*a* and 33*b*, a time until all the three side surfaces F3, F4, and F6 are completely cut is shortened as compared with a case where the three side surfaces F3, F4, and F6 of the wrapping material 301 are cut with one cutting member.

In the present embodiment, the first cutting members 31*a* and 31*b* are installed on the first side fence 102, the third cutting members 33*a* and 33*b* are installed on the second side fence 101, the second cutting members 32*a* and 32*b* are installed on the reference fence 107, and the first to third cutting members 31*a* and 31*b*, 32*a* and 32*b*, and 33*a* and 33*b* are formed to independently cut the side surfaces facing them, so that even in a case where the sheet pack 300 (sheet bundle PT) of different size is set in the feeding device 13, the cutting operation may be performed depending on the size (the size that may be cut is not limited).

Figure 9:
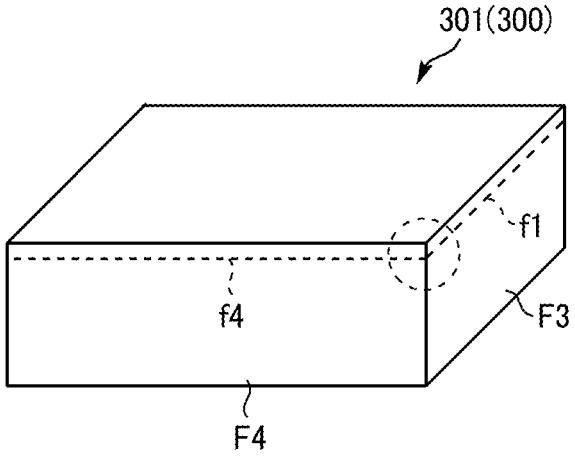
FIG. 9 is a perspective view illustrating the sheet pack.
Figure 10A:
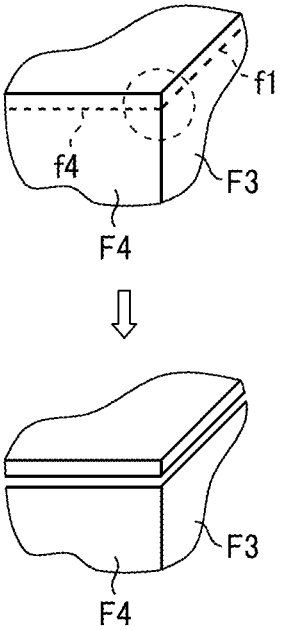
FIG. 10A is a diagram illustrating an operation when the sheet pack is normally cut.

Here, with reference to FIGS. 3, 9, 10A and the like, in the feeding device 13 according to the present embodiment, a height position cut by the first cutting members 31*a* and 31*b*, a height position cut by the second cutting members 32*a* and 32*b*, and a height position cut by the third cutting members 33*a* and 33*b* coincide with each other, and cut portions are coupled to each other.

Specifically, adjacent ones of the first guide 102*a*, the second guide 107*a*, and the third guide 101*a* are coupled to each other at the same height position. That is, the first guide 102*a*, the second guide 107*a*, and the third guide 101*a* are coupled at the same height position without being displaced in a height direction.

More specifically, adjacent ones of travel paths of the first upper cutting member 31*a*, the second upper cutting member 32*a*, and the third upper cutting member 33*a* are coupled at the same height. Similarly, adjacent ones of travel paths of the first lower cutting member 31*b*, the second lower cutting member 32*b*, and the third lower cutting member 33*b* are coupled at the same height.

With such a configuration, with reference to FIGS. 9 and 10A, the upper side f5 cut by the first upper cutting member 31*a* and the upper side f1 cut by the second upper cutting member 32*a* are coupled to each other, and the upper side f1 cut by the second upper cutting member 32*a* and the upper side f4 cut by the third upper cutting member 33*a* are coupled to each other. The lower side f6 cut by the first lower cutting member 31*b* and the lower side f2 cut by the second lower cutting member 32*b* are coupled to each other, and the upper side f1 cut by the second upper cutting member 32*a* and the lower side f3 cut by the third lower cutting member 33*b* are coupled to each other. That is, the wrapping material 301 is normally cut.

Figure 10B:
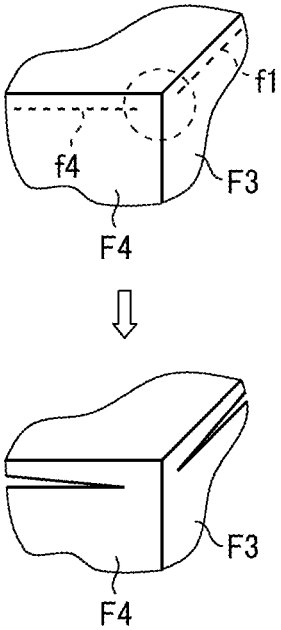
FIGS. 10B and 10C are diagrams illustrating an operation when the sheet pack is not normally cut.

On the other hand, with reference to FIG. 10B, in a case where adjacent ones of the travel paths of the first cutting members 31*a* and 31*b*, the second cutting members 32*a* and 32*b*, and the third cutting members 33*a* and 33*b* are not coupled each other at the same height, the wrapping material 301 is not normally cut.

Figure 10C:
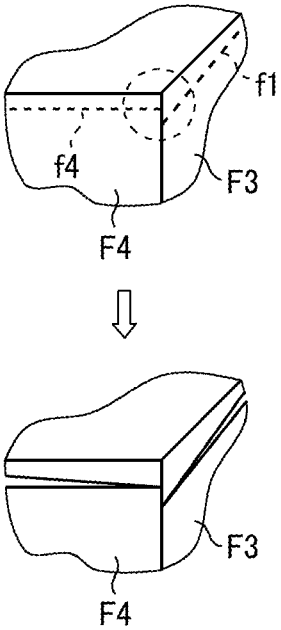

With reference to FIG. 10C, in a case where heights of adjacent ones of the travel paths of the first cutting members 31*a* and 31*b*, the second cutting members 32*a* and 32*b*, and the third cutting members 33*a* and 33*b* are not the same, the wrapping material 301 is not normally cut.

As described above, in the present embodiment, the height positions cut by the first to third cutting members 31*a* and 31*b*, 32*a* and 32*b*, and 33*a*, and 33*b* coincide with each other, and the cut portions are coupled to each other. Therefore, cutting failure of the wrapping material 301 does not occur, the time until the cutting is completed is shortened, and it is not necessary to take out the sheet bundle from the sheet pack.

Modification

In the feeding device 13 as a modification also, as described with reference to FIG. 5, the sheet pack 300 is cut in the clockwise direction (the same rotational direction) by the first to third cutting members 31*a* and 31*b*, 32*a* and 32*b*, and 33*a* and 33*b*.

Figure 11A:
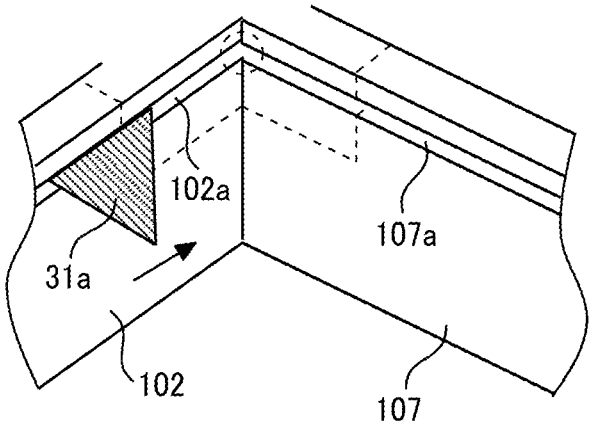
FIGS. 11A and 11B are perspective views illustrating an operation of a cutting member in the feeding device as a modification.
Figure 11B:
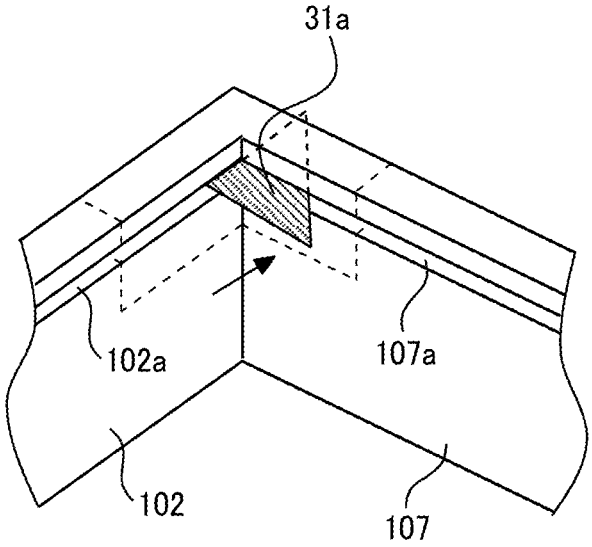

As illustrated in FIGS. 11A and 11B, in the feeding device 13 as the modification, the first cutting members 31*a* and 31*b* are movable to positions entering the second guide 107*a* on the downstream side in the feeding direction. With such a configuration, by the cutting operation, the upper side f5 of the first side surface F6 and the upper side f1 of the second side surface F3 of the wrapping material 301 are cut in a state of being reliably coupled, and the lower side f6 of the first side surface F6 and the lower side f2 of the second side surface F3 of the wrapping material 301 are cut in a state of being reliably coupled.

Although not illustrated, in the feeding device 13 as the modification, the second cutting members 32*a* and 32*b* are movable to positions entering the third guide 101*a* on the other end side in the width direction. With such a configuration, by the cutting operation, the upper side f1 of the second side surface F3 and the upper side f4 of the third side surface F4 of the wrapping material 301 are cut in a state of being reliably coupled, and the lower side f2 of the second side surface F3 and the lower side f3 of the third side surface F4 of the wrapping material 301 are cut in a state of being reliably coupled.

In a case where the sheet pack 300 is cut in the counterclockwise direction in FIG. 6 (the direction opposite to the cutting direction in FIG. 6) by the first to third cutting members 31*a* and 31*b*, 32*a* and 32*b*, and 33*a* and 33*b*, by forming the third cutting members 33*a* and 33*b* to be movable to positions entering the second guide 107*a* on the downstream side in the feeding direction, and forming the second cutting members 32*a* and 32*b* to be movable to positions entering the first guide 102*a* on one end side in the width direction, the effect similar to that described above may be obtained.

Here, with reference to FIGS. 11A and 11B, the first guide 102*a*, the second guide 107*a*, and the third guide 101*a* may be molded as a single member.

Specifically, by providing a pair of side fences 101 and 102 and the reference fence 107 molded as a single member, it is possible to easily couple the first guide 102*a*, the second guide 107*a*, and the third guide 101*a* at the same height position without variation in components as compared with a case where the respective fences are separately provided. Therefore, cutting failure of the wrapping material 301 does not occur, a time until the cutting is completed is shortened, and it is not necessary to take out the sheet bundle PT from the sheet pack 300.

Such a configuration is suitable for the feeding device in which the size of the sheet pack 300 (sheet bundle PT) to be set is determined to one size and the position in the width direction of a pair of side fences 101 and 102 is fixed (for example, the upper feeding device 12 when the side fence of the lower feeding device 13 in FIG. 1 is made movable and the side fence of the upper feeding device 12 is made unmovable).

As described above, the feeding device according to the present embodiment is the feeding device 13 that feeds the sheet P in a predetermined feeding direction, provided with the mount 105 on which the substantially rectangular parallelepiped sheet pack 300 including the sheet bundle PT and the wrapping material 301 wrapping the sheet bundle PT is mountable. The first cutting members 31*a* and 31*b* are provided that cut in the feeding direction the upper portion and the lower portion of the first side surface F6 located on one end side in the width direction orthogonal to the feeding direction out of the four side surfaces F3 to F6 of the sheet pack 300 mounted on the mount 105. The second cutting members 32*a* and 32*b* are provided that cut in the width direction the upper portion and the lower portion of the second side surface F3 located on the downstream side in the feeding direction out of the four side surfaces F3 to F6 of the sheet pack 300 mounted on the mount 105. The third cutting members 33*a* and 33*b* are provided that cut in the feeding direction the upper portion and the lower portion of the third side surface F4 located on the other end side in the width direction out of the four side surfaces F3 to F6 of the sheet pack 300 mounted on the mount 105. The height position cut by the first cutting members 31*a* and 31*b*, the height position cut by the second cutting members 32*a* and 32*b*, and the height position cut by the third cutting members 33*a* and 33*b* coincide with each other, and the cut portions are coupled to each other.

As a result, the time until the cutting of the wrapping material 301 in the sheet pack 300 is completed is shortened, and it is not necessary to take out the sheet bundle PT from the sheet pack 300.

Although the present disclosure is applied to the feeding device 13 installed in a monochrome image forming apparatus 1 in the present embodiment, but the present disclosure is naturally applicable to a feeding device installed in a color image forming apparatus.

Although the present disclosure is applied to the feeding device 13 installed in an electrophotographic image forming apparatus 1 in the present embodiment, the application of the present disclosure is not limited thereto, and the present disclosure is also applicable to a feeding device installed in other types of image forming apparatuses (for example, an inkjet type image forming apparatus, a stencil printing machine and the like).

Although the present disclosure is applied to the feeding device 13 installed inside the image forming apparatus 1 in the present embodiment, the present disclosure is also applicable to a feeding device installed so as to be exposed to the outside of the image forming apparatus 1.

Even in such cases, the effect similar to that of the present embodiment may be obtained.

Although only a part of the mount 105 (the lifting plate 106) is liftable up and down in the present embodiment, an entire mount 105 may be formed to be liftable up and down.

In the present embodiment, after the cutting of the wrapping material 301 of the sheet pack 300 installed in the feeding device 13 is finished, the feeding device 13 is temporarily pulled out from the body of the image forming apparatus 1, and the upper surface F1 is manually turned. On the other hand, the feeding device 13 may be provided with a turning mechanism for turning the upper surface F1, and the upper surface F1 may be automatically turned by the turning mechanism without pulling out the feeding device 13 from the body of the image forming apparatus 1 after the cutting of the wrapping material 301 of the sheet pack 300 installed in the feeding device 13 is finished.

Even in such cases, the effect similar to that of the present embodiment may be obtained.

It is obvious that the present disclosure is not limited to the present embodiment, and the present embodiment may be appropriately modified other than suggested in the present embodiment within the scope of the technological concept of the present disclosure. The number, position, shape and the like of the components are not limited to those of the present embodiment, and may be made the number, position, shape and the like suitable for implementing the present disclosure.

In the present specification and the like, the term of "sheet" is defined to include all of sheet-shaped recording media such as coated paper, label paper, and an overhead projector (OHP) transparency in addition to normal paper.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A feeding device to feed a sheet in a feeding direction, the feeding device comprising:

a mount on which a substantially rectangular parallelepiped sheet pack including a sheet bundle and a wrapping material wrapping the sheet bundle is mountable;

a first cutter to cut, in the feeding direction, an upper portion and a lower portion of a first side surface located on one end side of the sheet pack in a width direction orthogonal to the feeding direction out of four side surfaces of the sheet pack mounted on the mount;

a second cutter to cut, in the width direction, an upper portion and a lower portion of a second side surface located on a downstream side of the sheet pack in the feeding direction out of the four side surfaces of the sheet pack mounted on the mount; and a third cutter to cut, in the feeding direction, an upper portion and a lower portion of a third side surface located on another end side of the sheet pack in the width direction out of the four side surfaces of the sheet pack mounted on the mount, wherein a height position cut by the first cutter, a height position cut by the second cutter, and a height position cut by the third cutter coincide with each other, the feeding device further comprising:

a pair of side fences to determine a position in the width direction of the sheet pack mounted on the mount; and a reference fence to determine a position on the downstream side in the feeding direction of the sheet pack mounted on the mount, wherein:

the first cutter is to move along a first guide extending in the feeding direction on a first side fence located on one end side in the width direction out of the pair of side fences, the second cutter is to move along a second guide extending in the width direction on the reference fence, and the third cutter is to move along a third guide extending in the feeding direction on a second side fence located on another end side in the width direction out of the pair of side fences.

2. The feeding device according to claim 1, wherein:

the first cutter or the third cutter is movable to a position to enter the second guide on the downstream side in the feeding direction.

3. The feeding device according to claim 1, wherein:

the second cutter is movable to a position to enter the third guide on said another end side in the width direction, or is movable to a position to enter the first guide on the one end side in the width direction.

4. The feeding device according to claim 1, wherein:

the first guide, the second guide, and the third guide are molded as a single member.

5. The feeding device according to claim 1, wherein:

the first cutter is to move from an upstream side or the downstream side to the downstream side or the upstream side in the feeding direction to cut the sheet pack, the second cutter is to move from the one end side or said another end side to said another end side or the one end side in the width direction to cut the sheet pack, and the third cutter is to move from the downstream side or the upstream side to the upstream side or the downstream side in the feeding direction to cut the sheet pack.

6. The feeding device according to claim 1, wherein:

a part or entire of the mount is liftable up and down such that a downstream side in the feeding direction of an uppermost sheet mounted on the mount reaches a predetermined height position.

7. An image forming apparatus comprising the feeding device according to claim 1.

8. The feeding device according to claim 1, wherein:

a cut portion of the first side surface cut by the first cutter, a cut portion of the second side surface cut by the second cutter, and a cut portion of the third side surface cut by the third cutter are coupled to each other.

9. The feeding device according to claim 1, wherein:

adjacent guides of the first guide, the second guide, and the third guide are coupled to each other at a same height position.

10. A feeding device to feed a sheet in a predetermined feeding direction, the feeding device comprising:

a mount on which a substantially rectangular parallelepiped sheet pack including a sheet bundle and a wrapping material wrapping the sheet bundle is mountable;

a first cutter to cut, in the feeding direction, an upper portion and a lower portion of a first side surface located on one end side of the sheet pack in a width direction orthogonal to the feeding direction out of four side surfaces of the sheet pack mounted on the mount;

a second cutter to cut, in the width direction, an upper portion and a lower portion of a second side surface located on a downstream side of the sheet pack in the feeding direction out of the four side surfaces of the sheet pack mounted on the mount; and a third cutter to cut, in the feeding direction, an upper portion and a lower portion of a third side surface located on another end side of the sheet pack in the width direction out of the four side surfaces of the sheet pack mounted on the mount, wherein height positions of travel paths of the first cutter, the second cutter, and the third cutter coincide with each other, and the travel paths are coupled to each other, the feeding device further comprising:

a pair of side fences to determine a position in the width direction of the sheet pack mounted on the mount; and a reference fence to determine a position on the downstream side in the feeding direction of the sheet pack mounted on the mount, wherein the first cutter is to move along a first guide extending in the feeding direction on a first side fence located on one end side in the width direction out of the pair of side fences, the second cutter is to move along a second guide extending in the width direction on the reference fence, and the third cutter is to move along a third guide extending in the feeding direction on a second side fence located on another end side in the width direction out of the pair of side fences.

11. An image forming apparatus comprising the feeding device according to claim 10.

12. The feeding device according to claim 10, wherein:

adjacent guides of the first guide, the second guide, and the third guide are coupled to each other at a same height position.

* * * * *